US005984984A

United States Patent [19]

Ahmed

[11] Patent Number: 5,984,984

[45] Date of Patent: Nov. 16, 1999

[54] FUEL ADDITIVE COMPRISING ALIPHATIC AMINE, PARAFFIN AND CYCLIC HYDROCARBON

[76] Inventor: Syed Habib Ahmed, 2 Morecombe Terrace, London N18 1LA, United Kingdom

[21] Appl. No.: 09/009,547

[22] Filed: Jan. 20, 1998

[30] Foreign Application Priority Data

Oct. 10, 1997 [GB] United Kingdom ..... 9721584

[51] Int. Cl.[6] ..... C10L 1/22

[52] U.S. Cl. ..... 44/412; 44/432

[58] Field of Search ..... 44/412, 432

[56] References Cited

U.S. PATENT DOCUMENTS

| | | | |
|---|---|---|---|
| 3,523,769 | 8/1970 | Tooke | 44/432 |
| 3,920,698 | 11/1975 | Haemmerle et al. | 260/326.5 FM |
| 3,927,994 | 12/1975 | Romans | 44/63 |
| 3,927,995 | 12/1975 | Romans | 44/63 |
| 3,980,448 | 9/1976 | Haemmerle et al. | 44/63 |
| 4,011,057 | 3/1977 | Sayers | 44/52 |
| 4,081,252 | 3/1978 | Osborg | 44/53 |
| 4,197,081 | 4/1980 | Osborg | 431/2 |
| 4,235,811 | 11/1980 | Schulze et al. | 260/513 N |
| 4,244,703 | 1/1981 | Kaspaul | 44/56 |
| 4,298,708 | 11/1981 | Schulze et al. | 521/115 |
| 4,304,690 | 12/1981 | Schulze et al. | 252/526 |
| 4,328,004 | 5/1982 | Globus | 44/412 |
| 4,330,304 | 5/1982 | Gorman | 44/63 |
| 4,397,654 | 8/1983 | Hart | 44/412 |
| 4,424,063 | 1/1984 | Hart | 44/56 |
| 4,568,358 | 2/1986 | Courtney | 44/57 |
| 4,992,187 | 2/1991 | Adams et al. | 252/50 |
| 4,997,594 | 3/1991 | Walsh | 252/51.5 A |
| 5,004,479 | 4/1991 | Schon et al. | 44/302 |
| 5,141,524 | 8/1992 | Gonzalez | 44/340 |
| 5,197,997 | 3/1993 | Mozdzen et al. | 44/386 |
| 5,340,488 | 8/1994 | Adams et al. | 44/432 |
| 5,538,522 | 7/1996 | Ahmed | 44/412 |
| 5,700,301 | 12/1997 | Ahmed | 44/412 |

FOREIGN PATENT DOCUMENTS

| | | | |
|---|---|---|---|
| 0167358 | 1/1986 | European Pat. Off. | C10L 1/14 |
| 0990797 | 5/1965 | United Kingdom . | |
| 2085468 | 4/1982 | United Kingdom . | |
| 8201717 | 5/1982 | WIPO | C10L 1/22 |

*Primary Examiner*—Jerry D. Johnson
*Attorney, Agent, or Firm*—White & Case L.L.P.

[57] ABSTRACT

A composition suitable for use as a fuel additive is disclosed which comprises at least about 40% by volume of a paraffin which is selected from n-hexane and n-heptane, about 1% to about 20% by volume of aliphatic amine and at least about 5% by volume of cyclic hydrocarbon which has at least five carbon atoms and is liquid at 20° C., said aliphatic amine and cyclohexane having boiling points less than that of said paraffin. The additive improves the combustion process of the fuel such that particulate emission is reduced.

16 Claims, 4 Drawing Sheets

FUEL ADDITIVE COMPRISING ALIPHATIC AMINE, PARAFFIN AND CYCLIC HYDROCARBON

This invention relates to fuel additives. There is a need to reduce the type and amount of harmful pollutants formed in the combustion process of an internal combustion engine. In an internal combustion engine, on complete combustion, hydrocarbon fuels produce carbon dioxide and water vapour. However, in most combustion systems the reactions are incomplete, resulting in unburned hydrocarbons and carbon monoxide formation. Moreover, particulates may be emitted as unburnt carbon in the form of soot. Impurities in the fuel are also emitted in the form of oxides, typically sulphur oxides. Furthermore, in the high temperature zone of the combustion system, atmospheric and fuel bonded nitrogen is oxidised to nitrogen oxides, mainly nitrogen oxides and nitrogen dioxide.

The desired goal of reducing the amount of fall groups of pollutants especially HC, Pm and $NO_x$ is very difficult to achieve due to the mutually contradictory nature of the formation of these pollutants i.e. to prevent $NO_x$ formation requires a depletion of oxygen and to prevent HC, Pm requires an abundance of oxygen.

It will be appreciated that it is very difficult to establish the characteristics which are likely to enhance combustion of the fuel because of the complex nature of the combustion process. However, to achieve a better understanding of the combustion process it is convenient to model the process into three distinct zones, namely a preheat zone, the true reaction zone and a recombination zone. Degradation of the fuel occurs in the preheat zone where the fuel fragments leaving the zone generally comprise mainly of lower hydrocarbons, olefins and hydrogen. In the initial stages of the reaction zone the radical concentration is very high and oxidation proceeds mainly to CO and OH. Also in this region many other species are competing for the available atomic oxygen i.e. NO, SO and $SO_2$. The CO and OH species are thermodynamically favoured in reaction with oxygen to convert into $CO_2$ and $H_2O$ and so these reactions will be essentially complete in the early stages of the flame. If initiation occurs near the beginning of the reaction zone this will allow OH and CO species greater time to react with the available oxygen.

However, shortening the ignition-delay time will allow all other species to give greater time for reaction. This would increase harmful oxide emissions—especially so in modern lean burn engines with retarded injection.

Over recent years, great emphasis has been placed on reducing the regulated and visible emission. Thus, in general, research has been directed at reducing the size of the particulates which are emitted. While size does, of course, have an effect on the visibility of these particulates, the number of particulates is now realised to have an effect both on performance and also health.

Thus particle number has been linked to a decline in crank case oil performance. Vehicles with more advanced emission technologies such as higher injection pressures produce higher levels of soot in the lubricant. High levels have been identified as the main contributor to viscosity increase and wear and this will, in consequence, lead to higher fuel consumption and associated emissions.

The health effects associated with particulate levels have in many epidemiological studies shown significant association with a variety of human health end points, including mortality, hospital admissions, respiratory symptoms, etc. The U.S. six cities study showed a consistent and statistically significant relationship to acute mortality and fine particles (below 2.5 microns) ($PM_{2.5}$) concentrations. Although, much research work is needed to understand the underlying biological mechanism of the association, it is nevertheless quite apparent that particle number concentration and size does have a significant health effect. Reduction of total particle number would significantly improve air quality in terms of its health effects.

A number of approaches to improve the emissions have already been adopted with varying degrees of cost, applicability and success. However, the most desired and widely applicable approach involve the "clean diesel" fuels at the current specifications i.e. EM590 that produce regulated emissions under standard test cycles. The "city diesel" fuel contains only 0.0003% sulphur.

To achieve this objective, the most convenient and versatile approach is to use fuel additives. Already, additive packages of varying performance are increasingly used in many European diesel fuels. These additive packages give the fuel formulator added degrees of freedom in obtaining the designed fuel characteristics and performance. As refining practices become more constrained, fuel additives will play an increasing role in ensuring that the fully formulated fuel meets and exceeds the legislative emission requirements.

However, most fuel additives used at present are functional i.e. injector cleaners, corrosion inhibitors, lubricity modifiers, etc. and do not directly influence the combustion process where the emissions are essentially produced. Those additives which have claimed performance in the combustion system have not conclusively demonstrated their effect or are metallic based. It is apparent, though, that metallic additives are not the preferred route due to growing evidence of their deleterious effect on exhaust oxygen cells and OBD systems.

According to the present invention there is provided a fuel additive which affects the combustion process and thereby reduces the number of particles emitted. According to the present invention there is provided a composition which comprises at least 40% by volume of a paraffin which is n-hexane and/or n-heptane, 1 to 20% by volume of at least one aliphatic amine and at least 5% by volume of a cyclic hydrocarbon which has at least 5 carbon atoms and is liquid at 20° C., said aliphatic amine and said cyclic hydrocarbon having boiling points less than that of said paraffin.

The principal component of the additive comprises n-hexane or n-heptane, straight chain hydrocarbons. The use of C6-C7 hydrocarbons is very specific; thus the use of higher homologues is less advantageous.

The aliphatic amine used in the present invention is typically a monoamine or a diamine, which is typically primary or secondary. It will generally have 3 to 8, especially 3 to 6, carbon atoms. The number of nitrogen atoms will generally not exceed 2. Preferred amines include secondary monoamines and primary diamines, the former being especially preferred. Diisobutylamine is particularly suitable. Other suitable monoamines which may be employed include isopropyl amine and tertiary butyl amine. These amines will typically have a boiling point from 25 to 80° C., more preferably from 40 to 60° C. but this depend to some extent on the paraffin used which generally has a boiling point no greater than 200° C. and preferably no greater than 160° C. The amine is present in an amount from 1 to 20% by volume. Generally at least 1.5%, preferably at least 2.5%, by volume is present. A preferred concentration range is 1.5 to 10%, especially 2.5 to 5%, by volume.

The preferred cyclic hydrocarbons used in the present invention have 6 carbon atoms. They are preferably saturated. Cyclohexane is especially preferred although aromatic hydrocarbons such as benzene and toluene can be employed although are generally more expensive. As indicated, the cyclic hydrocarbon is present in an amount of at least 5% by volume, typically 10 to 30% and especially 15 to 25% by volume.

The paraffin is present in an amount of at least 40% by volume, typically 50 to 75% and preferably 55 to 65%. It has been found that it can be advantageous to use a mixture of hexane and heptane. In such circumstances the hexane generally predominates such that it represents typically 30 to 40% by volume of the composition while the heptane represents 20 to 30% by volume of the composition.

It will be appreciated that, in general, the composition of the present invention is in the form of a liquid solution.

Higher homologues can also be used provided that they are liquid at 20° C.

In addition, the composition can contain other ingredients, typically petroleum spirit or kerosene. Desirably, concentration of these additives does not exceed 20% by volume. Such additives generally act as a carrier for the other ingredients. There is no need for any metal-containing compounds in the composition. The presence of alcohols is generally undesirable.

A particularly preferred composition for use in the present invention is as follows:

| | |
|---|---|
| n-hexane | 35% |
| n-heptane | 25% |
| cyclohexane | 20% |
| diisobutylamine | 3.5% |
| petroleum spirit | 16.5%. |

It has surprisingly been found that the use of the compositions of this invention to diesel fuel can reduce the number of particles emitted on combustion very significantly.

The additive composition of the present invention may be included by the supplier of the fuel or it may be supplied in a package to be incorporated at a later stage, for example at the retail site. In general the additive will be employed at a treat rate of from 1:100 to 1:10,000 and preferably from 1:500 to 1:5,000, parts by volume of fuel, depending on the nature of the fuel. Accordingly, the present invention also provides a fuel which comprises the additive composition of the present invention.

Although the present invention is not bound by any particular theory, it is believed that the hexane and heptane will initiate the combustion reaction while the cyclic hydrocarbon will control the reaction.

Figure 1A:
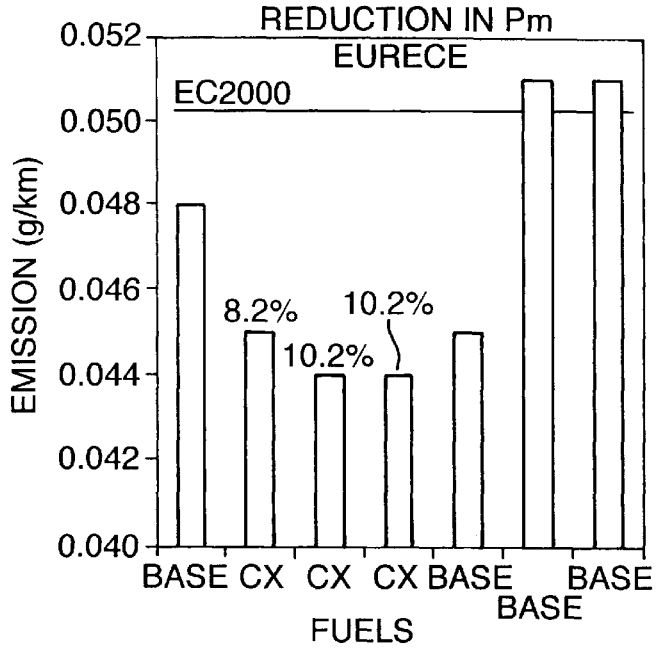
FIG. 1 shows the effect of the additive of the invention on emission of certain substances from a Mercedes Benz MB220D.
Figure 1B:
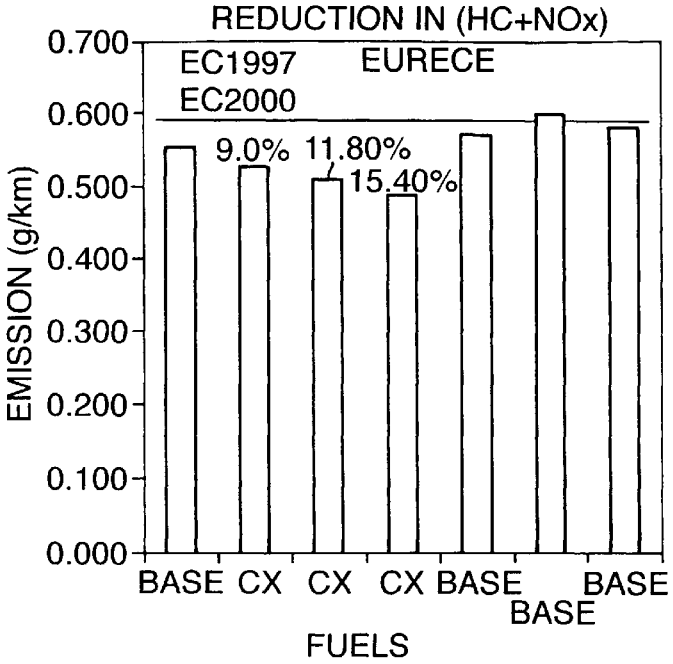
Figure 1C:
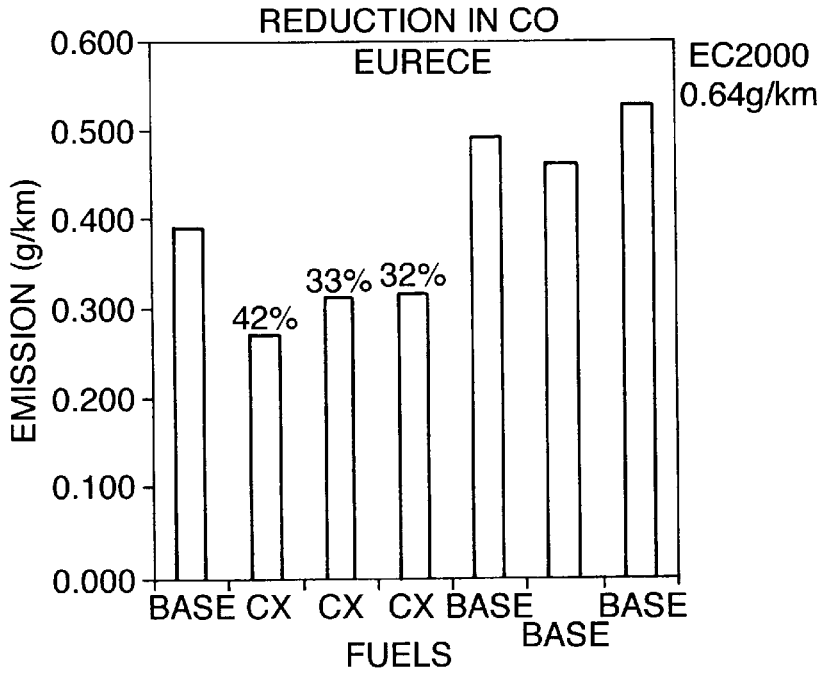
Figure 1D:
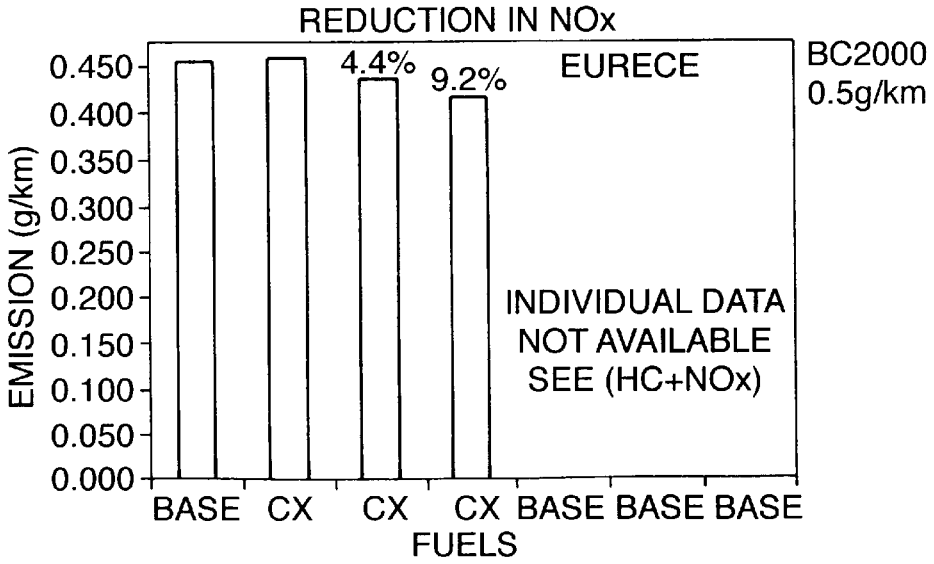
Figure 1E:
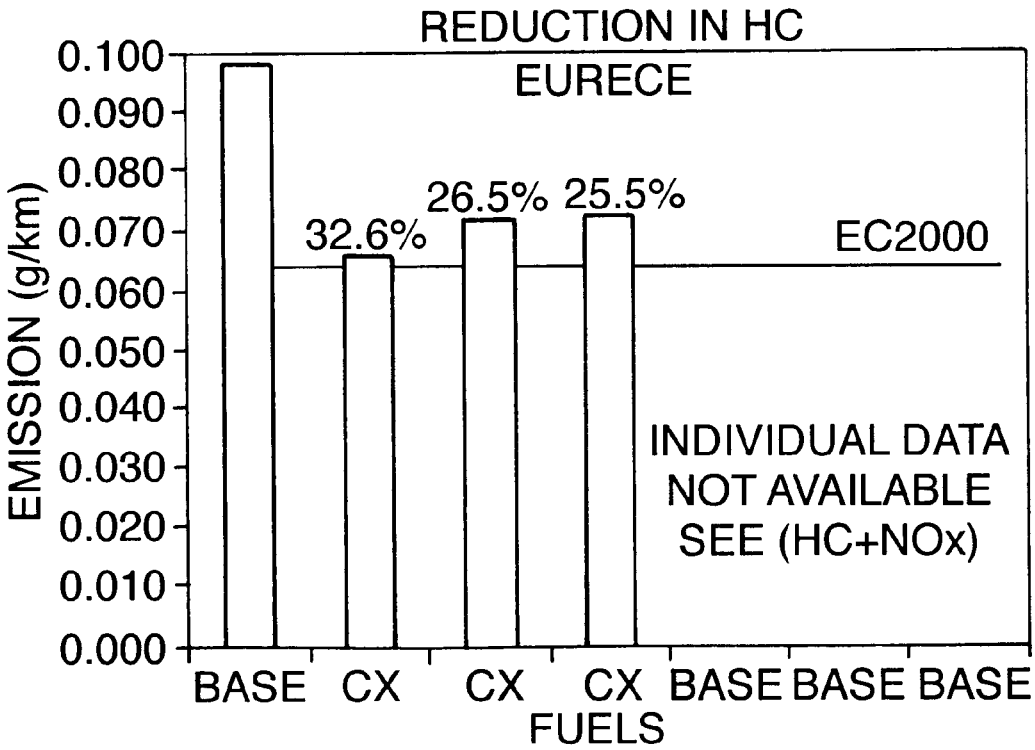

The following examples further illustrate the present invention.

EXAMPLE 1

Mercedes Benz MB 220D ECE15+EUDC

The additive of the invention was evaluated under the ECE 15+EUDC conditions in a 1997 model year, 4 cylinder, 2.2 liter engine fitted with EGR and Oxidation Catalyst (see Table I for technical data).

The results obtains were taken after the catalyst and show that the additive of the invention consistently reduces regulated emissions. The results are shown in FIG. 1.

Average Reductions Obtained

Average percentage reductions in emissions with the additive of the invention were compared to the average of the base runs i.e. 1 run prior to additive treatment and 3 runs on the base fuel after the additive treatment. The first base run was compared to historical data and was shown to have good repeatability.

Particles (Pm)=9.5%

(Hydrocarbon) HC+$NO_x$=12.1%

CO=35.7%

$NC_x$=6.8%

HC=28.2%

TABLE I

| MERCEDEZ BENZ C220D TECHNICAL DATA | |
|---|---|
| ENGINE PERFORMANCE | |
| Cylinders/Valves per cylinder | 4/4 |
| Capacity (CC) | 2155 |
| Maximum Power Output (kw/hp @ rpm) | 70 (95)/4800 |
| Maximum Torque Output (Nm/lbsft @ rpm) | 150 (111)/3100–4500 |
| Bore/Stroke | 89/86.6 |
| Compression Ratio | 22.1:1 |
| Top Speed (mph/kmh) | 109/175 |
| EQUIPMENT | |
| ENGINE | |
| Electronically controlled pre-chamber fuel injection | |
| Exhaust gas recirculation and oxidation catalyst | |
| Naturally Aspirated | |
| Twin overhead camshafts | |
| Hydraulic valve clearance compensation | |
| TRANSMISSION | |
| Five speed manual transmission | |
| Twin mass flywheel with manual transmission | |
| WEIGHTS | |
| Kerb Weight (kg) | 1400 |

EXAMPLE 2

Particle Size and Distribution

An investigation using the single cylinder Proteus engine (see Table II for technical data) was carried out to examine the influence of the additive of the invention on reducing the total number of particles. The results show that the additive of the invention significantly reduces the total number of particles emitted within the Pm2.5 range (see FIGS. 2 and 3).

TABLE II

| Proteus Engine Build Specification | |
|---|---|
| Engine Type | Ricardo Proteus Single Cylinder Research Engine No. 107 |
| Combustion system | Direct Injection, simulated turbocharger and aftercooler |
| Rated Power | 52 kw at 1900 rev/min |
| Peak Torque | 310 Nm at 1140 rev/min |
| Bore | 135 mm |
| Stroke | 150 mm |
| Swept Volume | 2.147 litres |

TABLE II-continued

| Proteus Engine Build Specification | |
|---|---|
| Engine Type | Ricardo Proteus Single Cylinder Research Engine No. 107 |
| Cylinder Head | 4 valves per cylinder, Central vertical Injection Inlet Swirl Ratio 1.1 Rs |
| Valve Timings | IVO = 15 BTDC, IVC = 35 ATDC, EVO = 50 BBDC, EVC = 13 ATDC |
| Compression Ratio | 16.0:1 |
| Combustion Chamber | Open Chamber, 90 mm diameter |
| Fuel Injection System | Electronically - controlled common rail system |

Measurement Techniques

Aerodynamic Diameter

The aerodynamic equivalent diameter is defined as the diameter of a unit density sphere having the same gravitational settling velocity as the particle under analysis. It is measured by time of flight analysers based on the assumption that particle inertia is directly linked to its size. Thus by accelerating particles under subsonic conditions and recording particle transit times the transit aerodynamic size can be determined. This measurement is generally used for particles between 0.1 $\mu$m and 10 $\mu$m.

The Scanning Mobility Particle Sizer (SMPS)

The Scanning Mobility Particle Sizer (SMPS) functions on the basis of the movement of gas-borne or aerosol borne particles possessing an electrical charge towards an electrode.

Particles entering the SMPS first pass through an impaction stage to remove any particles larger than 1 $\mu$m. The aerosol stream then enters a neutraliser where the particles are assigned charges. The positively charged particles then enter the electrostatic classifier. A given particles mobility within an electric field is proportional to its size.

The SMPS is generally used for measurement of particles between 10 nm and 450 nm.

RESULTS

Figure 2:
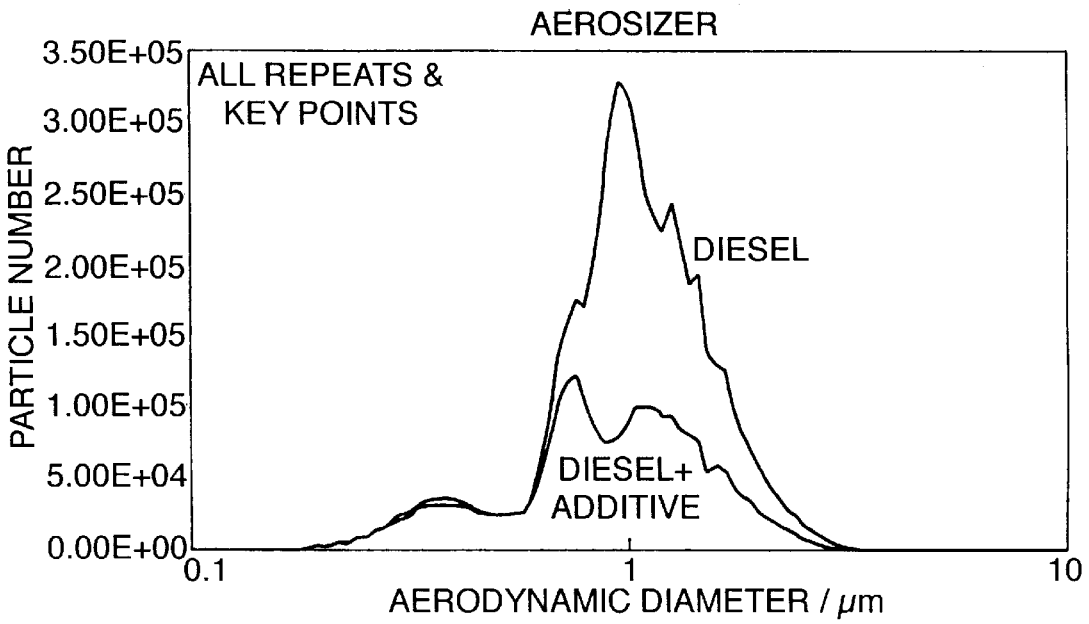
FIG. 2 shows the effect of the additive of the invention on the emission from a single cylinder Proteus engine of particles in the range of from 10 nm to 450 nm.
Figure 3:
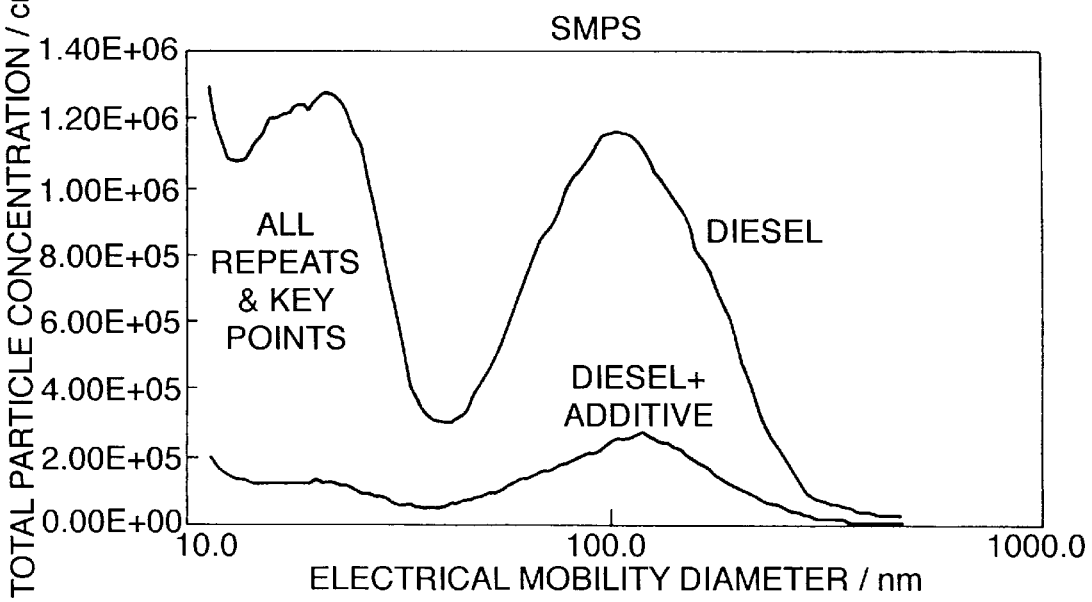
FIG. 3 shows the effect of the additive of the invention on the emission from a single cylinder Proteus engine of particles in the range of from 0.1 $\mu$m to 10 $\mu$m in size.

The data developed in the Proteus engine demonstrates that the additive of the invention reduces the total number of particles by over 80% compared to base fuel for particles in the range of 10 nm to 450 nm and by over 50% for particles in the range 0.45 $\mu$m to 4 $\mu$m. This is a significant reduction. The results for particles in the range of 10 nm to 450 nm are shown in FIG. 2. The results for particles in the range of 0.45 $\mu$m to 4 $\mu$m are shown in FIG. 3.

I claim:

1. A composition suitable for use as a fuel additive which comprises at least about 40% by volume of a paraffin which is selected from n-hexane and n-heptane, 1% to 20% by volume of at least one aliphatic amine and at least about 5% by volume of a cyclic hydrocarbon which has at least five carbon atoms and is liquid at 20° C., said aliphatic amine and said cyclic hydrocarbon having boiling points less than that of said paraffin.

2. A composition according to claim 1 in which the aliphatic amine is a secondary mono-amine or a primary diamine.

3. A composition according to claim 2 in which the aliphatic amine is diisobutylamine, isopropylamine or tertiary butyl amine.

4. A composition according to claim 1 in which the aliphatic amine is present in an amount from 1.5 to 10% by volume.

5. A composition according to claim 1 in which the cyclic hydrocarbon is present in an amount from 15 to 25% by volume.

6. A composition according to claim 1 in which the paraffin is present in an amount from 50 to 75% by volume.

7. A composition according to claim 1 in which the paraffin comprises a mixture of hexane and heptane.

8. A composition according to claim 7 which comprises 30 to 40% by volume of hexane and 20 to 30% by volume of heptane.

9. A composition according to claim 1 which comprises about 35% by volume of n-hexane, about 25% by volume of n-heptane, about 20% by volume of cyclohexane, about 3.5% by volume of diisobutylamine and about 16.5% by volume of petroleum spirit.

10. A fuel which comprises a composition according to claim 1.

11. A fuel according to claim 10 which contains 1:500 to 1:5000 parts by volume of the said composition.

12. A fuel according to claim 10 which is a diesel fuel.

13. A method of reducing particulate emissions from a fuel which comprise adding to the fuel a composition as claimed in claim 1.

14. A method according to claim 13 in which the fuel is diesel fuel.

15. A composition according to claim 1 in which the cyclic hydrocarbon is saturated.

16. A composition suitable for use as a fuel additive which comprises at least about 40% by volume of a paraffin which is selected from n-hexane and n-heptane, about 1% to about 20% by volume of aliphatic amine and at least about 5% by volume of cyclohexane, said aliphatic amine and cyclohexane having boiling points less than that of said paraffin.

* * * * *